US008677703B2

(12) United States Patent
Meyer

(10) Patent No.: US 8,677,703 B2
(45) Date of Patent: Mar. 25, 2014

(54) ARTICULATING CORNER RAISED ACCESS FLOOR PANEL

(76) Inventor: Gary Meyer, Golden, CO (US)

( * ) Notice: Subject to any disclaimer, the term of this patent is extended or adjusted under 35 U.S.C. 154(b) by 0 days.

(21) Appl. No.: 13/876,137

(22) PCT Filed: Sep. 27, 2010

(86) PCT No.: PCT/US2010/002623

§ 371 (c)(1),
(2), (4) Date: Mar. 26, 2013

(87) PCT Pub. No.: WO2012/044271

PCT Pub. Date: Apr. 5, 2012

(65) Prior Publication Data

US 2013/0186015 A1 Jul. 25, 2013

(51) Int. Cl.
*E04C 2/52* (2006.01)

(52) U.S. Cl.
USPC ..... 52/220.1; 52/263; 52/126.6

(58) Field of Classification Search
USPC ..... 52/126.1, 126.5, 126.6, 126.7, 177, 52/220.1, 220.2, 263
See application file for complete search history.

(56) References Cited

U.S. PATENT DOCUMENTS 3,150,748 A * 9/1964 Liskey, Jr. ..... 52/396.04
3,318,057 A * 5/1967 Norsworthy ..... 52/126.6
4,085,557 A * 4/1978 Tharp ..... 52/263
4,258,516 A * 3/1981 Mori et al. ..... 52/126.6
4,277,923 A * 7/1981 Rebentisch et al. ..... 52/126.6
4,593,499 A * 6/1986 Kobayashi et al. ..... 52/126.6
4,685,258 A * 8/1987 Av-Zuk ..... 52/126.6
4,893,441 A * 1/1990 Catalano et al. ..... 52/126.6
4,901,490 A * 2/1990 Zinniel et al. ..... 52/263
5,048,242 A * 9/1991 Cline ..... 52/126.6
5,386,670 A * 2/1995 Takeda et al. ..... 52/126.6
5,398,466 A * 3/1995 Oyama et al. ..... 52/126.6
5,749,188 A * 5/1998 Belbenoit ..... 52/263
5,791,096 A * 8/1998 Chen ..... 52/126.6
5,901,515 A * 5/1999 Chen ..... 52/263
5,983,582 A * 11/1999 Vugrek ..... 52/263
6,256,952 B1 * 7/2001 Fahy et al. ..... 52/263
6,363,685 B1 * 4/2002 Kugler ..... 52/745.05
6,442,906 B1 * 9/2002 Hwang ..... 52/126.6
6,519,902 B1 * 2/2003 Scissom ..... 52/126.4
7,360,343 B1 * 4/2008 Spransy et al. ..... 52/263
D588,716 S * 3/2009 Meyer ..... D25/142
7,509,782 B2 * 3/2009 Colosimo et al. ..... 52/792.1
7,644,550 B2 * 1/2010 Meyer ..... 52/263
7,650,726 B2 * 1/2010 Jakob-Bamberg et al. ..... 52/263
7,779,587 B1 * 8/2010 Meyer ..... 52/263
7,823,340 B2 * 11/2010 DeJonge et al. ..... 52/126.2
7,918,059 B2 * 4/2011 Repasky ..... 52/263
7,975,443 B2 * 7/2011 Meyer et al. ..... 52/223.6

(Continued)

*Primary Examiner* — Mark Wendell
*Assistant Examiner* — Gisele Ford
(74) *Attorney, Agent, or Firm* — Scott L. Terrell, P.C.; Scott L. Terrell

(57) ABSTRACT

An articulating raised access floor panel is provided. The floor panel plate has upper and lower surfaces, four edges defining four corner portions, and a diagonal clear slot positioned at each of the corner portions. A diagonal channel member is connected to the lower surface at each of the corner portions so that the channel member extends axially and parallel with the clear slot. A bar is slidably received in each of the channel members. The bar includes a leveling screw capable of operation through the clear slot so that the plate is capable of vertical adjustment with respect to a pedestal support system.

6 Claims, 4 Drawing Sheets

(56) References Cited

U.S. PATENT DOCUMENTS

| | | | | |
|---|---|---|---|---|
| 8,011,148 | B2 * | 9/2011 | Bertke et al. | 52/263 |
| 8,056,300 | B2 * | 11/2011 | Meyer | 52/745.06 |
| 8,091,302 | B2 * | 1/2012 | Meyer | 52/263 |
| 8,099,912 | B2 * | 1/2012 | DeJonge et al. | 52/126.2 |
| 8,365,475 | B2 * | 2/2013 | Zlatar | 52/126.6 |
| 8,429,860 | B2 * | 4/2013 | Kugler et al. | 52/126.6 |
| 8,458,974 | B2 * | 6/2013 | McIntosh et al. | 52/311.2 |
| 8,490,234 | B2 * | 7/2013 | Rowell et al. | 14/2.4 |
| 8,528,274 | B2 * | 9/2013 | Zlatar | 52/126.6 |
| 2005/0076590 | A1 * | 4/2005 | Wang et al. | 52/263 |
| 2009/0151271 | A1 * | 6/2009 | Meyer | 52/126.6 |
| 2009/0320393 | A1 * | 12/2009 | Meyer et al. | 52/223.6 |
| 2010/0180520 | A1 * | 7/2010 | Meyer | 52/126.6 |
| 2010/0180539 | A1 * | 7/2010 | Meyer | 52/745.05 |
| 2012/0009862 | A1 * | 1/2012 | Meyer | 454/184 |
| 2012/0164929 | A1 * | 6/2012 | Meyer | 454/184 |
| 2013/0104464 | A1 * | 5/2013 | Meyer | 52/126.6 |
| 2013/0186015 | A1 * | 7/2013 | Meyer | 52/126.5 |

* cited by examiner

ARTICULATING CORNER RAISED ACCESS FLOOR PANEL

CROSS REFERENCE TO RELATED APPLICATIONS

The application is a submission to enter the national stage, pursuant to 35 U.S.C. §371, of PCT/US2010/00263, filed 27 Sep. 2010.

BACKGROUND OF THE INVENTION

1. Field of the Invention

The present invention relates to raised access floor systems. In particular, it relates to a raised access floor panel for retrofit application without adjustment of modification to a pedestal support system of an existing construction.

2. Background Art

Access floors are components of a double floored construction and are commonly used to create a free space between a sub-floor and the normal working environment of a room. Raised access floor systems are so constructed that floor panels are mounted on a surface of a base floor such as a concrete floor, by means of support pedestal legs, whereby the free space may be provided between the floor panels and the base floor. The pedestal support legs are stationary and are typically bolted, or cemented, to the surface of the base floor at a predetermined position. A corner portion of each of the floor panels is supported at the upper end of the stationary pedestal support leg. Such systems are so constructed to provide an easy distribution of electric cables and ventilation duct work below the working surface. Such systems are well known in the art.

For example, in the prior art illustration of FIG. 15, U.S. Pat. No. 5,791,096 to Chen, a raised floor supporting structure includes a plurality of upright support legs, a plurality of top stringers 1419, and bottom stringers 1418 which are respectively connected between the upright supports at different elevations. Each upright support typically includes a circular bas 141 having an upright socket, a reinforced upright tube 1412 mounted in the upright socket, of the circular base 141, and is covered with a top cap. A screw member 144 is inserted through the center hole of the top cap into the upright tube 1412. A nut is threaded onto the screw member 144 and supported on the top cap and turned to adjust the elevation of the screw member 144. A pedestal head 143 is mounted on the screw member 144 at the top for holding floor panels 142. Each top stringer 1419 has a coupling portion, at each end, respectively, coupled to a the respective coupling portion of the pedestal head 143 of one upright support, and a pin hole at each end respectively coupled to a respective upright pin of the pedestal head 143 of the corresponding upright support. Each bottom stringer 1418 also has a coupling portion, at each end respectively, coupled to one reinforcing rib of the circular base 141 of one upright support, and a pin hole at each end respectively coupled to a respective upright pin at the corresponding reinforcing rib of the circular base of the corresponding upright support.

In yet another example, U.S. Pat. No. 5,072,557, to Nake et. al., discloses a device for fixing floor panels mounted on a surface of a base floor by means of using support legs which permit vertical adjustment of the floor panels. The fixing device includes a retainer plate, fixed to the base floor, for receiving the support legs, a support member extending vertically from the retainer plate and having an internally threaded portion, a panel holder, and a bearing member for the panel holder. The bearing member includes one end thereof threaded into the internally threaded portion of the support member for rotatable movement of the bearing member relative to the retainer plate. The bearing member is adapted to be accessible through the floor panels for operation. The panel holder is adapted to engage the bearing member in order fix the floor panels.

While the foregoing systems disclose an under-floor supporting structure for supporting raised access floor panels using a screw member to adjust the floor panels to a predetermined vertical height above a subfloor so as to achieve a planar working surface, a problem exists in the use of the foregoing supporting structures because they are limited in to the extent that they require repositioning and level adjustment of the pedestal support legs when installing floor panels having dimensions which differ from the original installation. Often times, when replacing the originally installed floor panels, one is required to replace all of the existing panels when the original panel design is found to be either unsuitable in application or cannot be found. A more common solution to this problem, which has found acceptance in the industry, lies in a design-build approach where each new panel is fabricated specifically to fit a specific original installation, but even with this approach the specifically designed panels may not suitable for uses when the configuration of the raised access floor systems vary from room-to-room without either vertically adjusting the screw member of the pedestal support leg, or repositioning the pedestal support in order to accept the newly installed panel. As one can easily appreciate, the design-build approach is a costly, time intensive and is a very inefficient solution to the problem. Therefore, what is needed is an articulating floor panel which is capable of horizontal and vertical interchangeable fit with existing pedestal support systems without out the need to modify the existing pedestal support system. The present invention satisfies these needs.

SUMMARY OF THE INVENTION

It is therefore an object of the present invention to provide an articulating floor panel which is capable of horizontal and vertical interchangeable fit with existing pedestal support systems without out the need to make modifications to the existing pedestal support system.

It is another object of the present invention to provide an articulating corner floor panel which is capable of horizontal and vertical adjustment from the upper working surface of the raised access floor.

It is another object of the present invention to provide an articulating corner floor panel which is capable of manufacture and inventory for immediate shipment and use.

It is yet another object of the present invention to provide a raised access floor panel which is capable of interchangeable and universal fit with access floor systems of different manufacture.

To overcome the problems of the prior art and in accordance with the purpose of the invention, as embodied and broadly described herein, briefly, an articulating corner raised access floor panel of the type for interchangeable fit on a pedestal support is provided. The floor panel includes a floor panel plate having an upper working surface, a lower plenum surface, and four edges defining the corner portions. Each of the corner portions include a diagonal clear slot along a diagonal vector defined with respect to the edges. An open channel member is connected to the lower surface at each of the corner portions so the channel member extends axially and parallel with the clear slot. A bar member is slidably received in each of the open channel members so that the bar is capable of free travel linearly along the diagonal vector. The bar includes at least one hole engaging a leveling screw. The leveling screw has an upper tool receiving end which is accessible through the clear slot in the plate so that the leveling screw is operable to adjust a vertical height of the plate so that the plate provides a planar working surface with adjacent panels.

Additional advantages of the present invention will be set forth in part in the description that follows and in part will be obvious from that description or can be learned from practice of the invention. The advantages of the invention can be realized and obtained by the apparatus particularly pointed out in the appended claims.

DESCRIPTION OF THE DRAWINGS

The accompanying drawings, which are incorporated in and which constitute a part of the specification, illustrate at least one embodiment of the invention and together with the description explain the principles of the invention.

DESCRIPTION OF THE PREFERRED EMBODIMENT

Unless specifically defined otherwise all technical or scientific terms used herein have the same meaning as commonly understood by one of ordinary skill in the art to which this invention belongs.

Although any methods and materials similar or equivalent to those described herein can be used in the practice or testing of the present invention, the preferred methods and materials are now described. Reference will now be made in detail to the presently preferred embodiments of the invention examples of which are illustrated in the accompanying drawings wherein like numerals represent like features.

Figure 1:
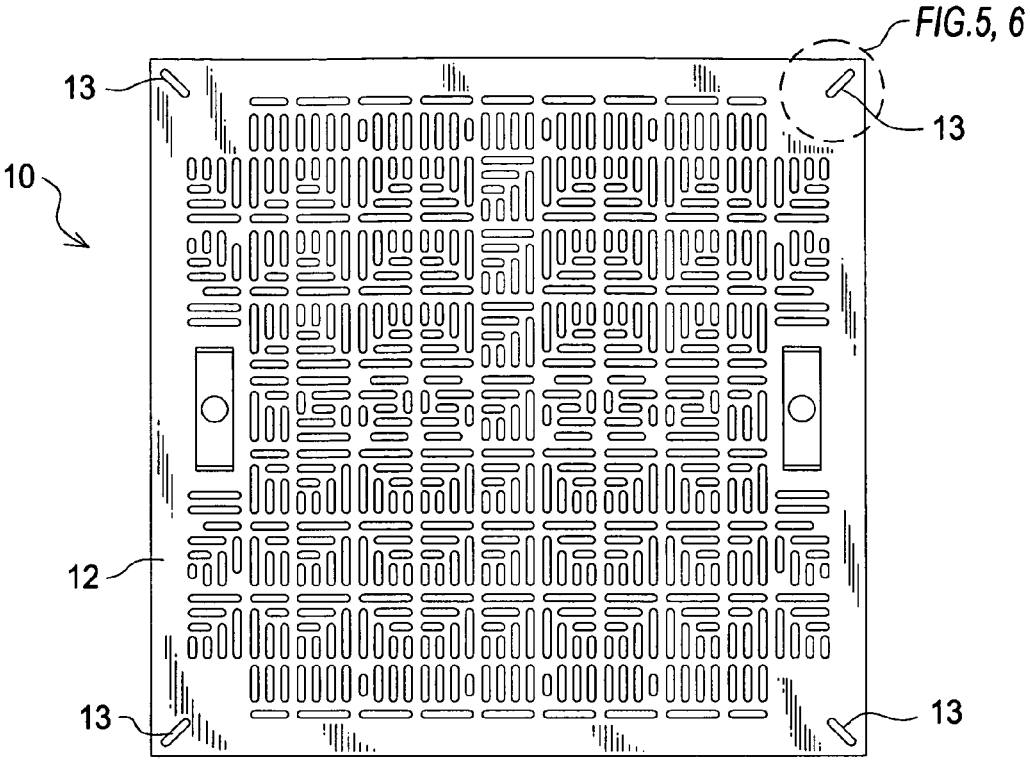
FIG. 1 is a top view of a perforated panel showing the diagonal clear slots at each of the corner portions.
Figure 2:
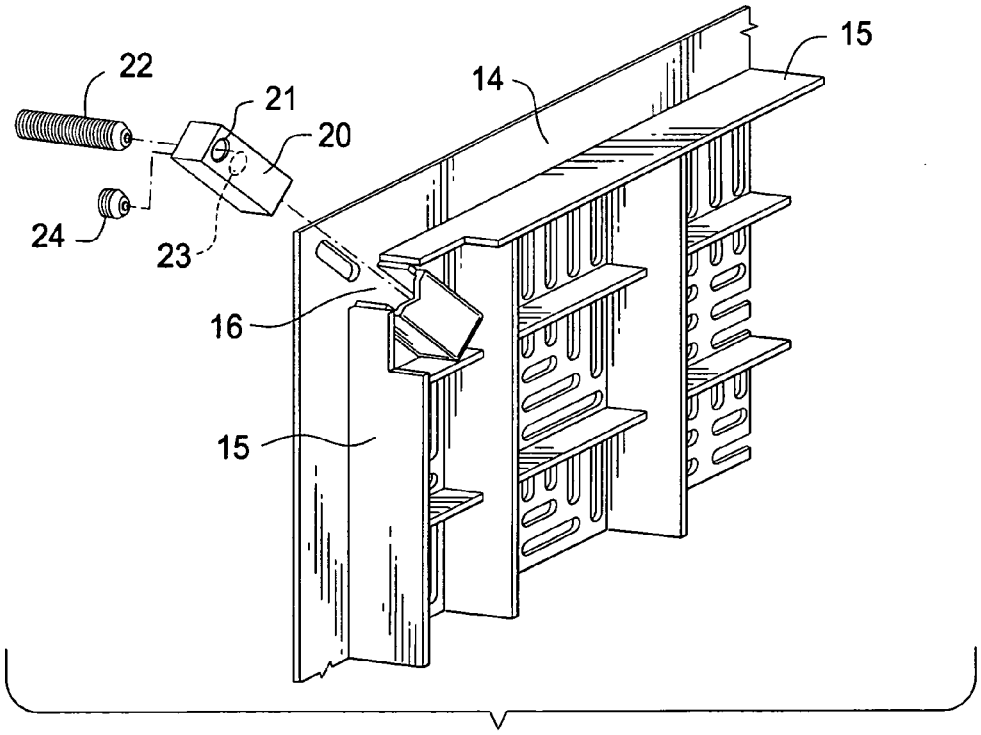
FIG. 2 is an exploded diagram taken from the lower surface of the floor panel showing a preferred embodiment of the articulating features of the present invention.
Figure 3:
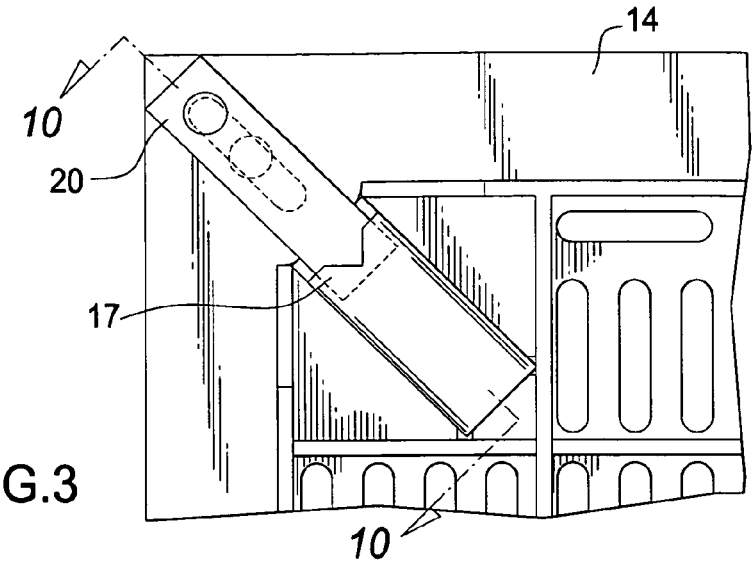
FIG. 3 is a bottom view of the articulating floor panel showing the bar member adjusted outwardly in relation to the channel member.
Figure 4:
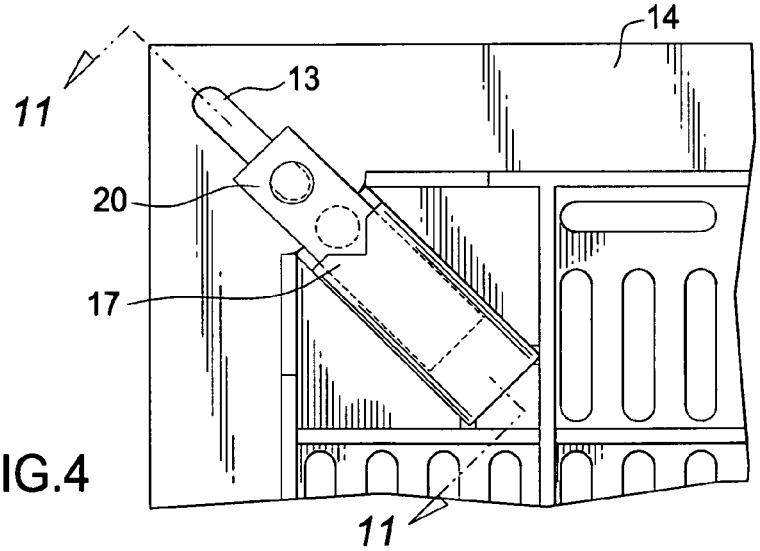
FIG. 4 is a bottom view of the articulating floor panel showing the bar member adjusted inwardly in relation to the channel member.
Figure 5:
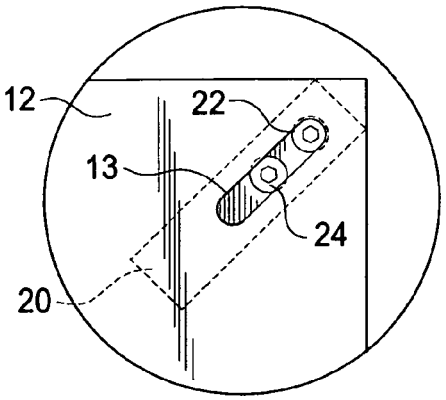
FIG. 5 is a top view of the articulating floor panel showing a preferred embodiment with an inboard set screw, having a diameter greater than the slot, for fastening the bar member in a predetermined position so that the panel is capable of having a footprint consistent with the existing pedestal head location.
Figure 6:
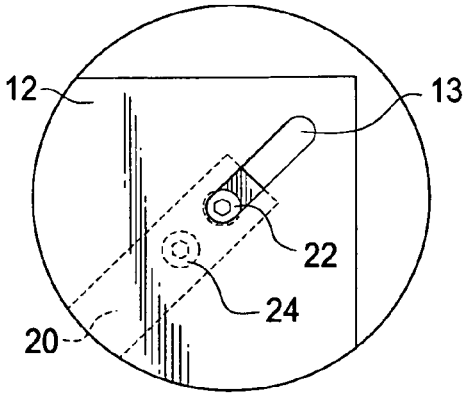
FIG. 6 is a top view of the articulating floor panel showing the outer periphery of the inboard set screw securing the bar member in a predetermined position to adjust the footprint of the panel.
Figure 7:
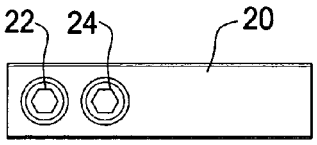
FIG. 7 is a top view of the bar member.
Figure 8:
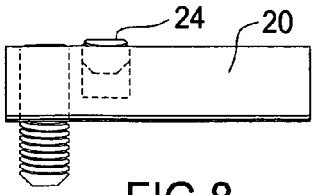
FIG. 8 is a side view of the outboard leveling screw extending downwardly for leveling the floor panel, and the inboard set screw extending upwardly for securing the bar member in a predetermined position.
Figure 9:
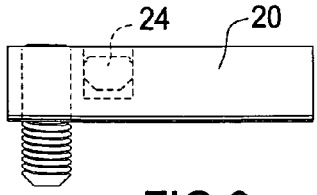
FIG. 9 is a side view showing the outboard leveling screw extending downwardly for leveling the floor panel with the inboard set screw adjusted downwardly so that the bar member is capable of sliding within the channel member.
Figure 10:
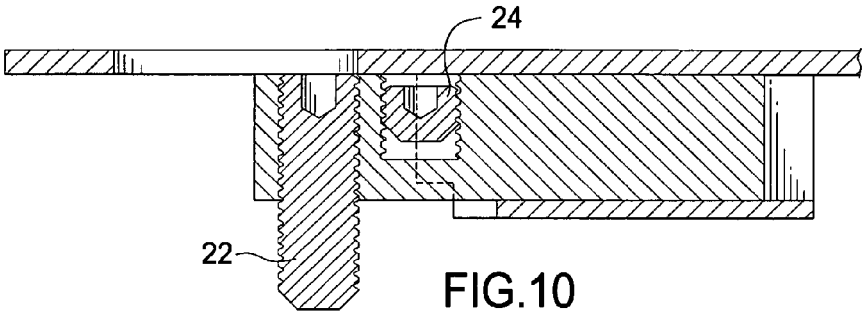
FIG. 10 is a sectional side view showing the outboard leveling screw extending downwardly for leveling the floor panel, and the inboard set screw extending downwardly so that the bar member is capable of sliding within the channel member.
Figure 11:
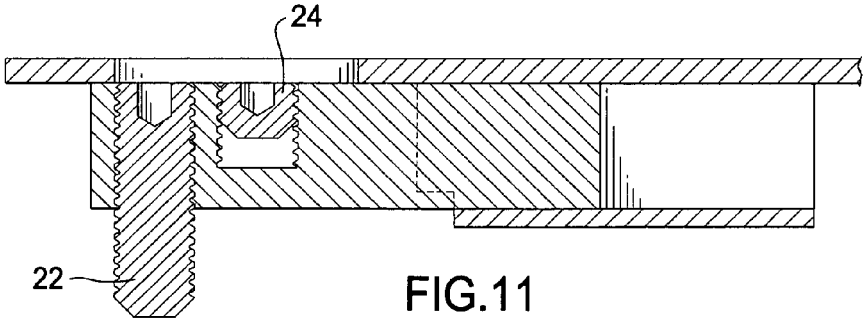
FIG. 11 is a side sectional view showing the outboard leveling screw extending downwardly for leveling the floor panel, and the inboard set screw extending upwardly for securing the bar member in a predetermined position.
Figure 12:
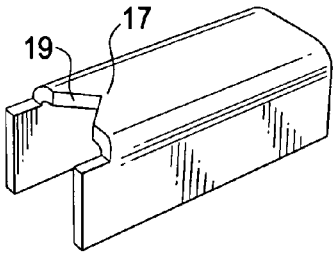
FIG. 12 is a perspective view of the channel member showing a preferred embodiment wherein the channel includes a recess for adjusting the footprint of the panel by hand.
Figure 13:
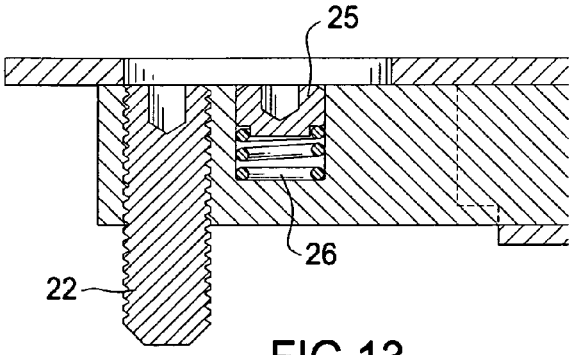
FIG. 13 is a side sectional view showing the outboard leveling screw extending downwardly for leveling the floor panel, and the inboard fastener in an embodiment where the fastener is a pin and spring tension assembly for compressible tensioning of the outer periphery of the pin to bias against the lower surface of the plate to secure the bar in a predetermined position.
Figure 14:
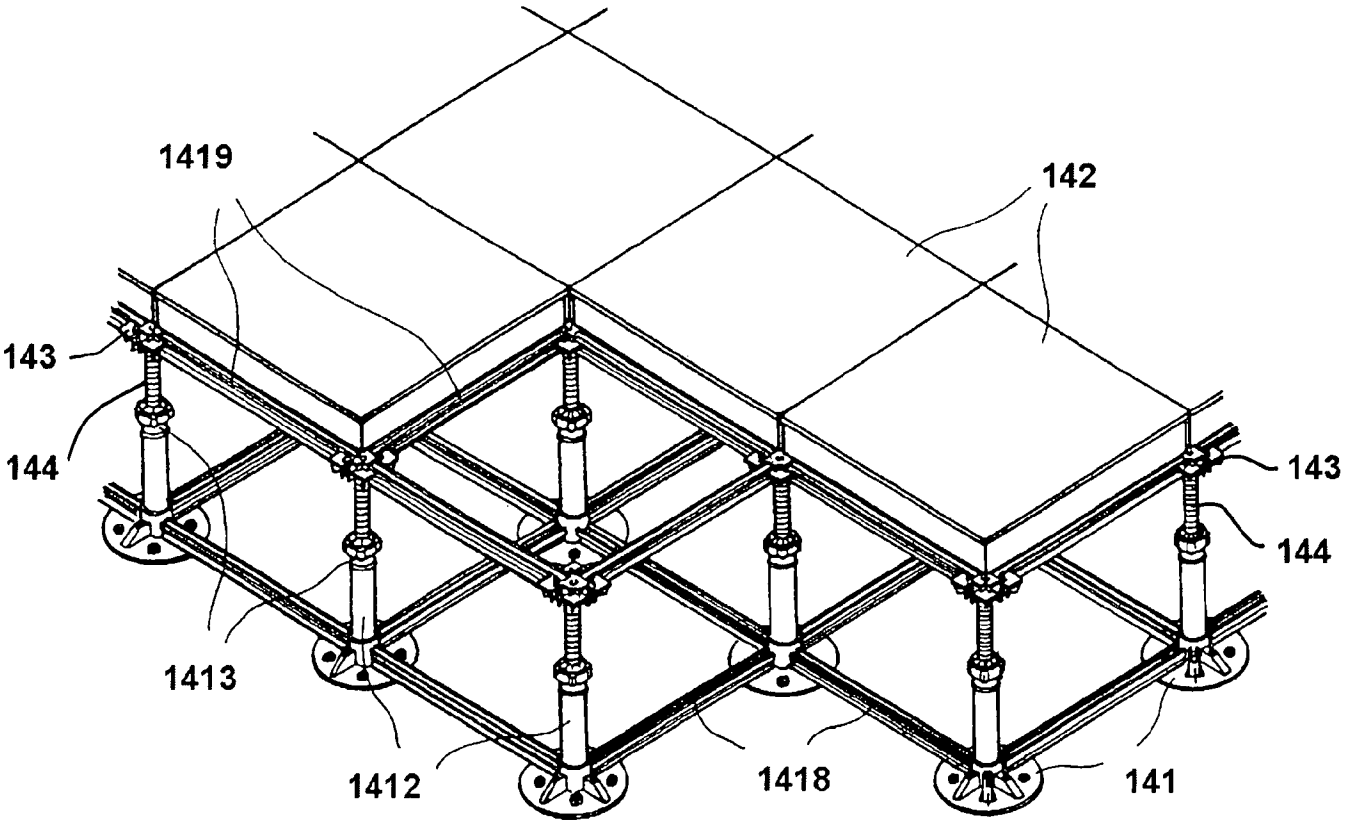
FIG. 14 (Prior Art)
FIG. 14 is a perspective view of yet one example of a pre-existing pedestal support system for use with the present invention without a need to make modifications to the component parts of the structure.

Referring now to FIG. 14, the present invention is useful in retro-fitting existing original equipment manufacture ("OEM") pedestal support systems with after market raised floor panels by eliminating a need to either vertically re-adjust the threaded post member 144 and/or move the existing pedestal support members, in order to fit panels of differing manufacture into a matrix defined by the existing pedestal support system.

A raised floor supporting structure typically includes a plurality of upright support members, connected in a matrix configuration with a plurality of top stringers 1419, and bottom stringers 1418. Each upright support includes a circular base 141 attached to the subfloor in a data center. The circular base 141 has an upright socket adapted to receive a reinforced upright support tube 1412. A threaded post member 144 is inserted through a center hole in the top cap of the upright tube 1412. A nut is threaded onto the post 144. The nut is turned to adjust the elevation of the screw post 144. A pedestal head 143 is mounted on the post 144. The pedestal head 143 is capable of attachment and support of the floor panels, and top stringers 1419. Each top stringer 1419 has a coupling, at each end thereof, which is adapted to couple the stringer to the pedestal head 143. Each bottom stringer 1418, also has a coupling connected to one reinforcing rib of the circular base 141 of the upright support.

The present invention provides an articulating raised access floor panel of the type for interchangeable fit on the existing pedestal support system without making modifications or adjustments in the level or location of the pedestal supports. The floor panel 10 includes a floor panel plate having an upper working surface 12, a lower plenum surface 14, and four structural sub frame members 15 connected to the lower surface 14 of the plate. The plate edges, and/or four side wall frame members 15, define four open corner portions 16. Each of the corner portions 16 include a diagonal clear slot 13 positioned along a diagonal vector defined with respect to the edges. The clear slots 13 are configured in a predetermined length and width. In the preferred embodiment, the clear slots 13 have an operational distance in a range of 6.35-38.1 mm. These dimensions are functionally related to the overall configuration of the OEM raised floor systems which have gained generally acceptance in the data center industry.

An open channel member 17 is connected, in axial and parallel horizontal alignment along the diagonal vector, to the lower plenum surface 14 at each of the corner portions 16 so as to extend downwardly in vertical alignment with the clear slots 13. In the preferred embodiment, the open channel member 17 includes a recessed bottom wall 19 for ease in sliding the bar member 20 by hand, and is square along its cross-sectional dimension. A bar member 20 is slidably received in each of the open channel members 17 so that the bar 20 slides in the channel member 17 a distance which varies linearly along the diagonal vector to establish a desired footprint of the panel. The bar member 20 includes at least one outboard internally threaded hole 21. At least one leveling set screw 22 is received in the hole 21. The leveling set screw 22 has an upper tool receiving end, accessible through the clear slot 13, so that by operation of the leveling set screw 22, from the upper working surface 12 of the raised access floor panel 10, one is capable of easily adjusting the vertical height of the floor panel 10 in relation to the pedestal head 143. This adjustment is desirable to establish the upper surface on plane with adjacent panels of existing construction.

As shown in the drawing figures, and as more particularly pointed out in the presently preferred embodiment, the bar member 20 includes both an inboard 23 and an outboard holes 21. As above, the outboard hole 21 is desirably an internally threaded clear hole for receiving the leveling set screw 22. The inboard hole 23 may be internally threaded to receive a threaded fastener 24, or may be sunk with an internally smooth bore for receiving a pin 25 and spring 26 compressible tension assembly capable of providing a compressible force exerted by the outer periphery of the pin 25 against the lower surface 14 of the floor panel 10 plate. In this manner, the inboard threaded fastener 24, or pin 25, has a diameter which is greater than the predetermined width of the clear slot 13 so that the tool receiving end of the inboard fastener is capable of biasing against the lower surface of the floor panel plate and secure the bar in a predetermined position to set the desired footprint of the floor panel plate.

In use, the articulating raised floor access panel 10, in accordance with the present invention, eliminates the need for re-adjusting the screw member 144 and/or repositioning the upright supports 1412 when installing other than OEM raised access floor panels on the OEM pedestal support systems. Installation of the floor panel 10 requires only that one select a desired location for the floor panel 10 to be replaced, and slide the bar member 20 inwardly, or outwardly, so that the bar member 20 fits with the established footprint of the existing pedestal head 143. The outboard leveling set screw 22 may, but need not, be operated through the clear slots 13 in the upper surface 12 of the floor panel 10 so that the floor panel 10 is positioned to establish a planar working surface with respect to the adjacent floor panels of the OME raised floor. The inboard fastening set screw 24 is then backed-out of the inboard hole 23, to bias snuggly against the lower plenum surface 14, so that the bar member 20 is secured in the predetermined desired position relative to the pedestal head 143. In this fashion, the present invention provides an articulating corner floor panel 10, which may be manufactured and held in stock for immediate shipping and use, but is which is capable of tight fitment with any OEM pedestal support system and/or panels of differing thicknesses, without a need to make adjustments or modifications to the existing pedestal supports.

While the present invention has been described in connection with the illustrated embodiments, it will be appreciated and understood that many modifications may be made without parting from the true spirit and scope of the invention.

I claim:

1. An articulating corner raised access floor panel for interchangeably fitting on a pedestal support system having a plurality of vertically extending pedestal support members each having an upper end connected to a pedestal support head and a lower end connected to a pedestal support base, the pedestal support heads each connected in a matrix orientation with a plurality of horizontal stringers, comprising:

(a) a floor panel plate having an upper working surface, a lower plenum surface, and four side wall structural frame members connected to the lower plenum surface defining four lower open corner portions wherein each of the corner portions includes a clear slot positioned along a diagonal vector with respect to the side walls and having a predetermined length and width;

(b) an open channel member connected in horizontal alignment along the diagonal vector to the lower plenum surface at each of the corner portions and extending downwardly in vertical alignment with the clear slot;

(c) a bar member slidably received in each open channel member including at least one hole so that the bar slides in the channel a distance which varies linearly along the diagonal vector; and (d) at least one leveling set screw received in the hole having an upper tool receiving end accessible through the clear slot so that the set screw adjusts a vertical height of the floor panel in relation to the pedestal head.

2. The articulating corner raised access floor panel according to claim 1, wherein the bar includes an inboard and an outboard holes for receiving an inboard securing set screw or pin and an outboard leveling set screw wherein the inboard set screw or pin has a diameter greater than the predetermined width of the clear slot so that the tool receiving end of the inboard set screw adjustably biases against the lower plenum surface when operated outwardly for securing the bar along a predetermined distance on the diagonal vector.

3. The articulating corner raised access floor panel according to claim 1, wherein the clear slot has an operational distance in a range of 6.35-38.1 mm.

4. The articulating corner raised access floor panel according to claim 1, wherein the bar and channel are four sided.

5. The articulating corner raised access floor panel according to claim 2, wherein the inboard hole is internally smooth for receiving a spring tension pin assembly.

6. The articulating corner raised access floor panel according to claim 2, wherein the outboard hole and outboard set screw are threaded and the inboard hole includes a smooth internal surface and the inboard set screw is a spring tensioned pin.

* * * * *